United States Patent [19]

Fu et al.

[11] Patent Number: 4,822,479

[45] Date of Patent: Apr. 18, 1989

[54] METHOD FOR IMPROVING THE PROPERTIES OF PREMIUM COKE

[75] Inventors: Ta-Wei Fu; Bruce A. Newman, both of Ponca City, Okla.

[73] Assignee: Conoco Inc., Ponca City, Okla.

[21] Appl. No.: 125,967

[22] Filed: Nov. 27, 1987

Related U.S. Application Data

[63] Continuation-in-part of Ser. No. 933,419, Nov. 21, 1986, abandoned.

[51] Int. Cl.[4] ..... C10G 9/14

[52] U.S. Cl. ..... 208/131; 208/50

[58] Field of Search ..... 208/131, 50

[56] References Cited

U.S. PATENT DOCUMENTS

| | | | |
|---|---|---|---|
| 3,745,110 | 7/1973 | Alfred | 208/131 |
| 3,956,101 | 5/1976 | Hara et al. | 208/50 |
| 4,049,538 | 9/1977 | Hayashi et al. | 208/50 |
| 4,066,532 | 1/1978 | Garcia | 208/131 |
| 4,519,898 | 5/1985 | Allan | 208/131 |
| 4,547,204 | 10/1985 | Sze et al. | 208/131 |

FOREIGN PATENT DOCUMENTS 155163 3/1985 European Pat. Off. .

*Primary Examiner*—Glenn Caldarola

*Attorney, Agent, or Firm*—C. R. Schupbach

[57] ABSTRACT

Properties of premium coke are improved by coking the feed at a temperature lower than the normal coking temperature and thereafter subjecting the coke to a heat soak at substantially the same temperature as the temperature at which the coke was formed.

6 Claims, 2 Drawing Sheets

METHOD FOR IMPROVING THE PROPERTIES OF PREMIUM COKE

This application is a continuation-in-part of application Ser. No. 933,419 filed Nov. 21, 1986, abandoned.

BACKGROUND AND SUMMARY OF THE INVENTION

There is an increasing demand for higher quality premium coke for the manufacture of large graphite electrodes for use in electric arc furnaces employed in the steel industry. The quality of premium coke used in graphite electrodes is often measured by its coefficient of thermal expansion, which can vary from as low as $-5$ to as high as $+8$ centimeters per centimeter per degrees centigrade times $10^{-7}$. Users of premium coke continuously seek graphite materials having lower CTE values. Even a small change in CTE can have a substantial effect on large electrode properties. Graphite electrode density is also of importance in characterizing the quality of graphite electrodes. Usually the higher the density, the better the electrode.

Premium coke is manufactured by delayed coking in which heavy hydrocarbon feedstocks are converted to coke and lighter hydrocarbon products. In the process the heavy hydrocarbon feedstock is heated rapidly to cracking temperatures and is fed continuously into a coke drum. The heated feed soaks in the drum and its contained heat which is sufficient to convert it to coke and cracked vapors. The cracked vapors are taken overhead and fractionated with the fractionator bottoms being recycled to the feed if desired. The coke accumulates in the drum until the drum is filled with coke at which time the heated feed is diverted to another coke drum while the coke is removed from the filled drum. After removal, the coke is calcined at elevated temperatures to remove volatile materials and to increase the carbon to hydrogen ratio of the coke.

In the manufacture of large graphite electrodes, calcined premium coke particles obtained from the delayed coking process are mixed with pitch and then baked at elevated temperatures to carbonize the pitch.

According to this invention, premium coke having improved properties is obtained by subjecting the coke to a heat soak which is carried out at substantially the same temperature as that used in the coking operation. Coke properties are also improved by coking at lower temperatures than those normally used in the coking operation.

PRIOR ART

U.S. Pat. No. 4,547,284 discloses a premium coking process wherein coking is carried out at lower than normal temperatures and the resulting coke is heat soaked at a temperature higher than the coking temperature, preferably at least 18° F. higher.

European Patent Application No. 155,163 discloses temperature soaking or drying out of coke. Three procedures are described (1) raising the drum temperature while the coke is forming, particularly during the latter stages of the coke formation, (2) after the coke is formed by shutting off the fresh feed portion of the charge to the coke drum and recycling coker products or a portion thereof as hot vapor through the already formed mass of coke, and (3) holding the already formed coke at a temperature above 750° F.

DETAILED DESCRIPTION OF THE INVENTION

The fresh feedstocks used in carrying out the invention are heavy aromatic mineral oil fractions. These feedstocks can be obtained from several sources including petroleum, shale oil, tar sands, coal, and the like. Specific feedstocks include decant oil, also known as slurry oil or clarified oil, which is obtained from fractionating effluent from the catalytic cracking of gas oil and/or residual oils. Another feedstock which may be employed is ethylene or pyrolysis tar. This is a heavy aromatic mineral oil which is derived from the high temperature thermal cracking of mineral oils to produce olefins such as ethylene. Another feedstsock is vacuum resid which is a heavy residual oil obtained from flashing or distilling a residual oil under a vacuum. Still another feedstock is vacuum gas oil which is a lighter material obtained from flashing or distillation under vacuum. Thermal tar may also be used as a feedstock. This is a heavy oil which is obtained from fractionation of material produced by thermal cracking of gas oil or similar materials. Heavy premium coker gas oil is still another feedstock and is the heavy oil obtained from liquid products produced in the coking of oils to premium coke. Gas oil from coking operations other than premium coking may also be employed as a feedstock. Virgin atmospheric gas oil may also be used as a feedstock. This is gas oil produced from the fractionation of crude oil under atmospheric pressure or above. Another feedstock which may be used is extracted coal tar pitch. Any of the preceding feedstocks may be used singly or in combination. In addition, any of the feedstocks may be subjected to hydrotreating and/or thermal cracking prior to their use for the production of premium grade coke.

Figure 1:
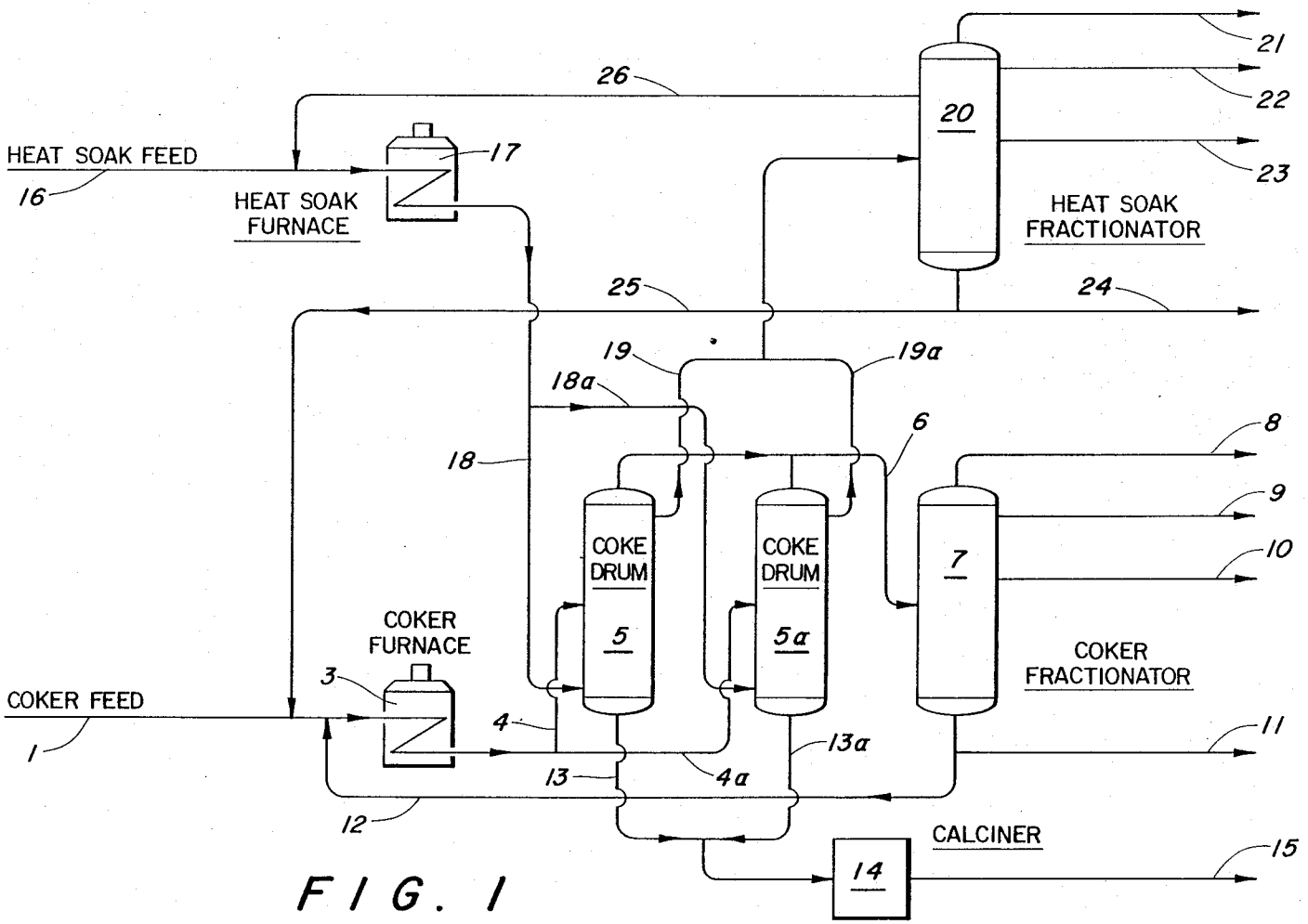
FIG. 1 is a schematic flow diagram which illustrates the invention.

Referring now to FIG. 1, feedstock is introduced to the coking process via line 1. The feedstock which in this instance is a thermal tar is heated in furnace 3 to temperatures normally in the range of about 800° to about 1050° F. and preferably between about 850° F. and about 950° F. A furnace that heats the thermal tar rapidly to such temperatures such as a pipestill is normally used. Heated thermal tar exits the furnace at substantially the above indicated temperatures and is introduced through line 4 into the bottom of coke drum 5 which is maintained at a pressure of between about 15 and about 200 psig. The coke drum operates at a temperature in the range of about 780° to about 1000° F. and more usually between about 800° F. and about 925° F. Inside the drum the heavy hydrocarbons in the thermal tar crack to form cracked vapors and premium coke.

The vapors are continuously removed overhead from the drum through line 6. Coke accumulates in the drum until it reaches a predetermined level at which time the feed to the drum is shutoff and switched to a second coke drum 5*a* wherein the same operation is carried out. This switching permits drum 5*a* to be taken out of service, opened and the accumulated coke removed therefrom using conventional techniques. The coking cycle may require between about 16 and about 60 hours, but more usually is completed in about 24 to about 48 hours.

Prior to removing the coke from coke drum 5, the coke contained therein is subjected to a heat soak at substantially the same temperature as the temperature at which the coking operation was carried out. The heat soak is effected by a non-coking fluid which is introduced to the unit through line 16, is heated in heat soak furnace 17 and passed from the heat soak furnace as a vapor through line 18 into the bottom of the coke drum. The heat soak material exits from the top of the coke drum through line 19 and is introduced to heat soak fractionator 20. The vapor stream entering fractionator 20 contains not only the heat soak material but also lighter and heavier materials released from the coke during the heat soak operation. Within fractionator 20 the vapors are fractionated into a $C_1$–$C_3$ product stream 21, a gasoline stream 22, a heavy gas oil stream 23, and a still heavier gas oil which is removed from the fractionator via line 24. If desired, a portion of the latter material may be combined with the feed to the coker.

Any material which is non-coking and does not affect the properties of the premium coke may be used as the heat soak material. For example, the heat soak material may be a liquid hydrocarbon fraction or a normally gaseous material such as light hydrocarbons, nitrogen, steam or the like. Usually a distillate or a light gas oil will be employed since these materials are readily available and are unaffected by the heat soak temperature. In this instance, a light gas oil is used as the heat soak material. If desired, it may be recovered from the heat soak fractionator and recycled to the heat soak furnace through line 26.

When carrying out heat soaking, as described herein, namely at substantially the same temperature as the coking operation, it is possible to operate the coke drum at lower than ordinary coking temperatures and at the same time obtain a product having improved physical properties, in particular a lower CTE value. Surprisingly the CTE of the coke improves as the coking (and heat soak) temperature is reduced as described by $TS_N$ values as defined herein. Improved and more desirable properties are CTE values as low as possible, and VBD values as high as possible.

Returning now to the drawing, vapors that are taken overhead from the coke drums in the coking operation are carried by line 6 to a coker fractionator 7. As shown in the drawing, the vapors will typically be fractionated into a $C_1$–$C_3$ product stream 8, a gasoline product stream 9, a heavy gas oil product stream 10, and a premium coker heavy gas oil taken from the fractionator via line 11.

As indicated previously, the premium coker heavy gas oil from the fractionator may be recycled at the desired ratio to the coker furnace through line 12. Any excess net bottoms may be subjected to conventional residual refining techniques if desired.

Green coke is removed from coke drums 5 and **5*a* through outlets 13 and 13*a*, respectively, and introduced to calciner 14 where it is subjected to elevated temperatures to remove volatile materials and to increase the carbon to hydrogen ratio of the coke. Calcination may be carried out at temperatures in the range of between about 2000° F. and about 3000° F. but preferably calcining is done at temperatures between about 2400° F. and about 2600° F. The coke is maintained under calcining conditions for between about one-half hour and about 10 hours and preferably between about 1 to about 3 hours. The calcining temperature and time of calcining will vary depending on the properties desired in the final coke product. Calcined premium coke which is suitable for the manufacture of large graphite electrodes is withdrawn from the calciner through outlet 15**.

The invention has been described as utilizing both a coker fractionator and a heat soak fractionator. It is within the scope of the invention however to carry out both operations in a single fractionator, in which event the effluent from the coke drums during both coking and heat soak would be fed to this fractionator. All of the streams normally recovered from the two fractionators would then be obtained from the single fractionator. It is only necessary that the $TS_N$ conditions for coke of desired properties be met.

The heat soak operation normally will be carried out over a time period of between about 4 and about 60 hours and preferably from about 8 to about 32 hours. The particular time employed will depend on the feedstock used in the coking operation, the time of coking and the coking temperature, but these conditions must be combined to yield $TS_N$. The $TS_N$ describes the amount of heat soak necessary to produce coke having CTE and VBD values in the premium coke range. The combination of temperature and time during heat soak plug the combination of temperature and time during the coking stage for cokes produced according to the present invention follow the expression:

$$TS_{Coking}+TS_{Soak}\geqq TS_N \qquad [1]$$

where:

$TS_{Coking}$=thermal severity during the coking stage;

$TS_{Soak}$=thermal severity during the soak stage; and $TS_N$=thermal severity necessary to produce premium coke for all feedstock entering the coking drum during the fill cycle.

Thermal severity is determined by the equation:

$$TS=[exp(-52873/T[^\circ R])]X\ [RX\ time,\ hr] \qquad [2]$$

where:

RX time is the time during which coking and/or heat-soak of the feedstock occurs; and T is the temperature of the coke or coke-forming liquid.

In general, for most commercial coke drums, T is about 5° F. to 60° F. higher than the drum vapor temperature. More commonly, T ranges from about 15° F. to about 30° F. higher than the drum vapor temperature.

$TS_N$ is defined from the equation:

$$TS_N=exp\ (0.050\ X\ f_a-39.8) \qquad [3]$$

where:

$f_a$=percentage of carbon atoms in the aromatic form as measured by $C^{13}$NMR analysis.

For many commercial cases, it is economically feasible to choose coking and heat-soak conditions that satisfy Equation [1] even for the part of the feed which undergoes the least reaction severity—that is, even for the last drop of feed to enter the coke drum. For cases where extremely low coking temperatures are used in combination with relatively aromatic feeds, satisfying Equation [1] for the last feed to enter a commercial drum would require excessively long heat-soak times.

In these cases, practicality requires heat-soak times according to:

$$TS_{Soak} \geqq TS_M \quad [4]$$

where:

$TS_M$ = the minimum thermal severity during the soak stage required to produce acceptable CTE and VBD on a drum average basis for coke produced in the entire drum.

$TS_M$ is defined from the equation:

$$TS_M exp\ (0.050\ X\ f_a - 42.8) \quad [5]$$

In a preferred embodiment of the present invention, the soak time is chosen so that Equation [1] is satisfied for coke formed in all parts of the drum, even for feedstock entering the drum late in the fill cycle. Because $TS_{Coking}=0$ for the last drop of feed to enter a standard commercial coke drum, Equation [1] reduces in the case of standard commercial coking to:

$$TS_{Soak} \geqq TS_N \quad [6]$$

A broader thermal severity range ensures that average coke properties from an entire commercial coke drum are those of premium coke even in the case of a less-severe heat soak. This range is defined by Equations [4] and [5].

The following examples illustrate the results obtained in carrying out the invention. Table 1 shows the physical properties of the feedstocks used in the examples.

TABLE 1

| Description of Feedstocks | Example No. | | | | |
|---|---|---|---|---|---|
| Feedstock Type | 1 Thermal Tar | 2 Thermally-Cracked Decant Oil | 3 Thermally-Cracked Decant Oil | 4 Thermal Tar | 4 Thermally-Cracked Decant Oil |
| Specific Gravity, 60/60 Deg F. | 1.036 | 1.097 | 1.105 | 1.006 | 1.085 |
| API Gravity | 5.1 | −2.5 | −3.4 | 9.2 | −1.1 |
| Sulfur, Wt % | 0.66 | 0.30 | 0.34 | 0.68 | 0.48 |
| $C^{13}$NMR, % Aromatic Carbon Atoms | 58.7 | 73.3 | 73.4 | 43.3 | 73.9 |
| Metals, ppm | | | | | |
| V | <1.0 | — | <0.06 | <1.0 | <1.0 |
| Ni | <1.0 | — | <0.2 | <1.0 | <1.0 |
| Fe | <8.0 | — | 0.34 | <4.0 | <4.0 |
| $TS_N$*, $10^{-17}$, hr | 9.8 | 20.0 | 20.4 | 4.5 | 20.9 |

*$TS_N$ = thermal severity necessary to produce coke of the lowest CTE and highest VBD.

EXAMPLE 1

A thermal tar with physical properties shown in Table 1 was coked in a laboratory-scale, batchwise coke drum for 8 hours at 100 psig and at temperatures of 825°, 850°, 875°, and 900° F. The same thermal tar also was coked under identical conditions, except with 8-hour, 24-hour, and 56-hour heat-soaks conducted at the coke-formation temperature.

Table 1 shows that $TS_N$ for this thermal tar, as calculated from Equation [3], is $9.8\times10^{-17}$hr.

Results from the coking experiments are shown in Table 2. The results clearly shows that a heat soak dramatically improves coke properties. Increasing the length of the heat soak is most clearly beneficial generally when the combined thermal severity for coking and heat-soak is less than $9.8\times10^{-17}$hr. The best coke properties, low CTE and high VBD, are obtained at lower coking and heat-soak temperatures, when the combined thermal severity is equal to or greater than about $9.8\times10^{-17}$hr.

Figure 2:
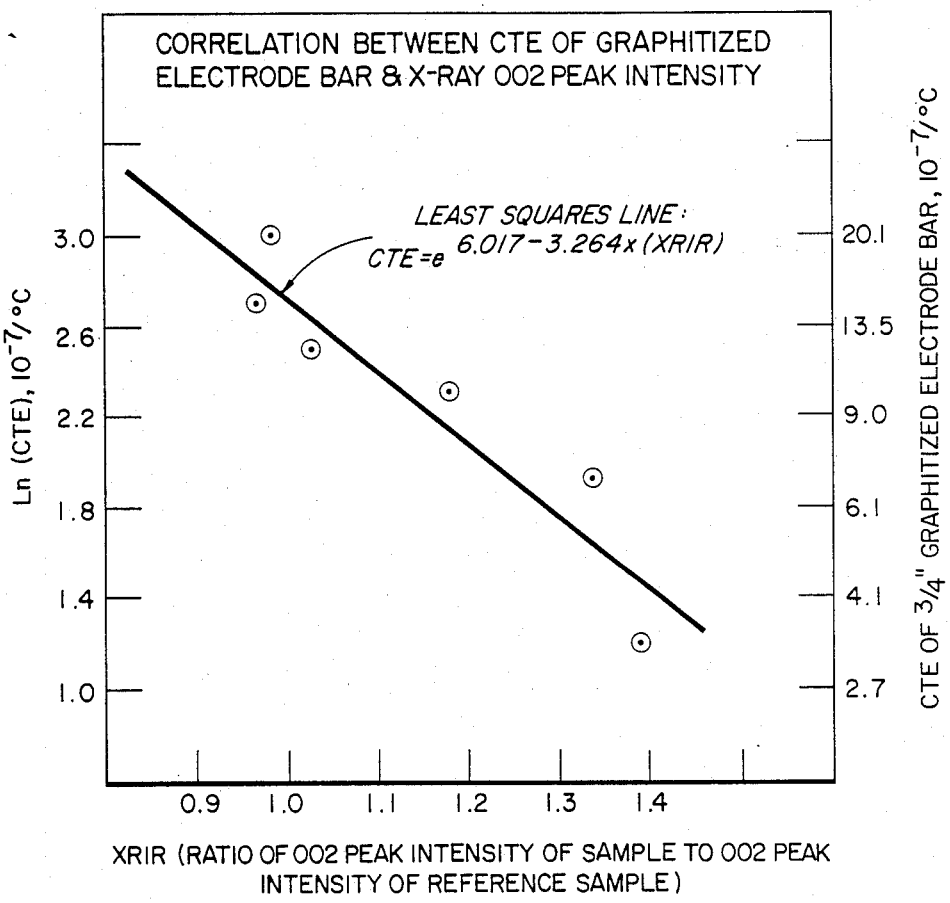
FIG. 2 shows the correlation between two commonly used methods for determining coke coefficient of thermal expansion.

CTE can be measured by using a ¾" graphitized electrode bar or by the x-ray method from the intensity of the 002 graphite peak. The two methods have a definite, determinable relationship as shown by FIG. 2. CTE results from either method can be directly correlated to results obtained using the alternate method.

TABLE 2

| EXPERIMENTAL RESULTS FOR EXAMPLE 1 | | | | | | | | | | | | |
|---|---|---|---|---|---|---|---|---|---|---|---|---|
| Temperature of Coke-Forming Liquid & Coke, °F. | 8 hr Coking | | | 8 hr Coking + 8 hr Soak | | | 8 hr Coking + 24 hr Soak | | | 8 hr Coking + 56 hr Soak | | |
| | TS* $10^{-17}$, hr | CTE** $10^{-7}$/°C. | Coke VBD, 8 × 14, g/cc | TS | CTE** | Coke VBD | TS | CTE** | Coke VBD | TS | CTE** | Coke VBD |
| 825 | 1.1 | — | — | 2.2 | 6.5 | .664 | 4.3 | 3.1 | .651 | 8.6 | 2.1 | .917 |
| 850 | 2.4 | 7.5 | .695 | 4.7 | 3.2 | .695 | 9.5 | 2.3 | .902 | 18.9 | 2.1 | .882 |
| 875 | 5.1 | 3.7 | .773 | 10.1 | 2.4 | .896 | 20.2 | 2.5 | .893 | 40.3 | 2.3 | .873 |
| 900 | 10.4 | 3.9 | .855 | 20.9 | 3.2 | .892 | 41.8 | 3.2 | .864 | 83.6 | 3.5 | — |

*TS = thermal severity = [exp (−52873/T[°R])] × [Rx time, hr.]
**Determined by an X-ray method from the intensity of the 002 peak of graphite.

EXAMPLE 2

A thermally-cracked decant oil with physical properties shown in Table 1 was coked in a laboratory-scale, batchwise coke drum for 8 hours at 60 psig and at 825°, 850°, 875°, and 900° F. The same decant oil also was coked under identical conditions, except with 8-hour, 24-hour, 56-hour, and 88-hour heat-soaks conducted at the coke formation temperature.

Table 1 shows that $TS_N$ for this decant oil is $20.3\times10^{-17}$hr.

Results from the coking experiments are shown in Table 3. Again, a heat soak is shown to dramatically improve the coke CTE. In this case, increasing the length of the heat soak is most clearly beneficial generally when the combined thermal severity for coking and heat soak is less than $20.3\times10^{-17}$hr.

The best CTE again is obtained at lower coking and heat-soak temperatures and when the combined thermal severity approaches or is greater than $TS_N$.

TABLE 3

EXPERIMENTAL RESULTS FOR EXAMPLE 2

| Temperature of Coke-Forming Liquid & Coke, °F. | 8 hr Coking TS* $10^{-17}$, hr | 8 hr Coking CTE** $10^{-7}$/°C. | 8 hr Coking + 8 hr Soak TS | 8 hr Coking + 8 hr Soak CTE** | 8 hr Coking + 24 hr Soak TS | 8 hr Coking + 24 hr Soak CTE** | 8 hr Coking + 56 hr Soak TS | 8 hr Coking + 56 hr Soak CTE** | 8 hr Coking + 88 hr Soak TS | 8 hr Coking + 88 hr Soak CTE** |
|---|---|---|---|---|---|---|---|---|---|---|
| 825 | 1.1 | 11.8 | 2.2 | — | 4.3 | 1.54 | 8.6 | .93 | 13.0 | .78 |
| 850 | 2.4 | 6.64 | 4.7 | 1.39 | 9.5 | .98 | 18.9 | .90 | 28.4 | .96 |
| 875 | 5.1 | 1.90 | 10.1 | 1.31 | 20.2 | .90 | 40.3 | 1.21 | | |
| 900 | 10.4 | 1.64 | 20.9 | 1.27 | 41.8 | 1.46 | | | | |

*TS = thermal severity = [exp (−52873/T[°R])] × Rx time, hr.
**Determined by the X-ray method.

EXAMPLE 3

A thermally-cracked decant oil, which is described in Table 1, was coked at 55 psig in a continuous-feed pilot plant that simulates a commercial coking operation. Experimental conditions and coking results are presented in Table 4. $TS_N$ and $TS^M$ for this feedstock, calculated from Equations [3] and [5], are $20.4\times10^{-17}$hr and $1.0\times10^{-17}$hr, respectively. Alphabetical groups B through E in Table 4 show a comparison of heat soak versus no heat soak, or in the case of Group E, a same-temperature heat soak versus an elevated-temperature heat soak.

Results for experiments without a heat-soak are presented in Group A of Table 4. Experiment Nos. 1 and 2 of Group A were conducted at conditions such that even the feed that entered the drum first (that is, the feed in the coke drum for the longest period) did not achieve a thermal severity equal to $TS_N$. In Experiments 3 and 4, the thermal severity for the first feed entering the coke drum was $65.7\times10^{-17}$, which exceeds $TS_N$. However, even in these experiments, roughly the last 31 wt. % (percentage determined by $[(20.4\times10^{-17}\text{hr}/65.7\times10^{-17}\text{hr})\times100]$) of feed which entered the coke drum did not experience thermal severity equal to $TS_N$.

In Groups B, C, and D of Table 4, the effect of a heat-soak at substantially the coking conditions presented in Group A is shown. In each case, a heat-soak is shown to be generally beneficial to coke properties. Experiment 5 of Group B shows that a low CTE can be achieved using a heat-soak ($2.8\times10^{-17}$hr) which is only slightly more severe than the $TS_M$ value of $1.0\times10^{-17}$hr. Inspection of results from Experiment 8 (Group B), Experiment 9 (Group C), and Experiment 7 (Group D) show that coke of the best properties (low CTE and high VBD), is achieved as the coking and heat-soak temperatures decrease.

Group E of Table 4 shows the effect of a heat-soak at substantially the temperature of coke formation (Experiment 8), compared with the effect of a heat-soak at a temperature higher than the temperature of coke formation as described by the prior art as represented by U.S. Pat. No. 4,547,284 (Experiments 10 and 11). In Experiments 10 and 11, heat soak temperatures were about 60° F. and about 90° F. higher, respectively, than the coking temperature. Experiment 8 clearly produces coke of superior properties. Clearly, coke with superior properties is obtained by soaking at a temperature near the temperature of coke formation.

TABLE 4

EXPERIMENTAL RESULTS FOR EXAMPLE 3

| | | Coking Conditions | | | | | Heat Soak Conditions | | | | | Coke Properties | |
|---|---|---|---|---|---|---|---|---|---|---|---|---|---|
| Group | Expt. No. | Temp. of Coke-Forming Liquid & Coke, °F. | Fill Time, hr | Drum Vapor Temp., °F. | Maximum Thermal Severity,[a] $10^{-17}$, hr | Percentage Incomplete[b] | Temp., of Coke-Forming Liquid & Coke, °F. | Soak Time, hr | Drum Vapor Temp., °F. | Thermal Severity, $10^{-17}$, hr | Total TS,[c] Coking + Heat Soak, $10^{-17}$, hr | CTE[e] $10^{-7}$/°C. | VBD, g/cc, 8 × 14 Mesh |
| A | 1 | 835 | 32 | 800 | 5.9 | 100 | — | 0 | — | 0 | 5.9 | d | d |
| | 2 | 858 | 32 | 841 | 12.1 | 10 | — | 0 | — | 0 | 12.1 | 3.4 | 0.787 |
| | 3 | 916 | 32 | 877 | 65.7 | 31 | — | 0 | — | 0 | 65.7 | 2.7 | 0.763 |
| | 4 | 916 | 32 | 886 | 65.7 | 31 | — | 0 | — | 0 | 65.7 | 3.8 | 0.826 |
| B | 1 | 835 | 32 | 800 | 5.9 | 100 | — | 0 | — | 0 | 5.9 | d | d |
| | 5 | 832 | 32 | 771 | 5.4 | 100 | 831 | 16 | 777 | 2.6 | 8.0 | 2.8 | 0.707 |
| | 8 | 831 | 32 | 810 | 5.2 | 100 | 834 | 32 | 800 | 5.7 | 10.9 | 0.8 | 0.870 |
| C | 2 | 858 | 32 | 841 | 12.1 | 100 | — | 0 | — | 0 | 12.1 | 3.4 | 0.787 |
| | 6 | 857 | 32 | 842 | 11.7 | 100 | 857 | 16 | 822 | 5.9 | 17.6 | 2.0 | 0.791 |
| | 9 | 859 | 32 | 812 | 12.5 | 100 | 860 | 32 | 800 | 12.9 | 25.4 | 1.5 | 0.781 |
| D | 3 | 916 | 32 | 877 | 65.7 | 31 | — | 0 | — | 0 | 65.7 | 2.7 | 0.713 |
| | 4 | 916 | 32 | 886 | 65.7 | 31 | — | 0 | — | 0 | 65.7 | 3.8 | 0.826 |
| | 7 | 920 | 32 | 888 | 73.4 | 28 | 920 | 16 | 876 | 36.7 | 110.1 | 2.3 | 0.826 |
| E | 8 | 831 | 32 | 810 | 5.2 | 100 | 834 | 32 | 800 | 5.7 | 10.9 | 0.8 | 0.870 |
| | 10 | 829 | 32 | 779 | 4.9 | 100 | 891 | 16 | 843 | 16.1 | 21.0 | 1.2 | 0.803 |

TABLE 4-continued

EXPERIMENTAL RESULTS FOR EXAMPLE 3

| | | Coking Conditions | | | | | Heat Soak Conditions | | | | | Coke Properties | |
|---|---|---|---|---|---|---|---|---|---|---|---|---|---|
| Group | Expt. No. | Temp. of Coke-Forming Liquid & Coke, °F. | Fill Time, hr | Drum Vapor Temp., °F. | Maximum Thermal Severity,[a] $10^{-17}$, hr | Percentage Incomplete[b] | Temp., of Coke-Forming Liquid & Coke, °F. | Soak Time, hr | Drum Vapor Temp., °F. | Thermal Severity, $10^{-17}$, hr | Total TS,[c] Coking + Heat Soak, $10^{-17}$, hr | CTE[e] $10^{-7}$/°C. | VBD, g/cc, 8 × 14 Mesh |
| | 11 | 831 | 32 | 815 | 5.2 | 100 | 920 | 16 | 872 | 36.7 | 41.9 | 1.3 | 0.794 |

[a]Maximum thermal severity is the thermal severity during the coking stage experienced by feed which has been in the coke drum for the longest period of time.
[b]Percentage incomplete is the percentage of the feedstock which experiences thermal severity less than the amount required to produce coke of the best properties ($TS_N$). It is calculated from the equation:

$$\text{Percentage incomplete} = \frac{TS_N}{\text{Max. Ther. Sev.}} \times 100 \text{ when } TS_N \text{ is less than Max. Ther. Sev.}$$

[c]Total TS = total thermal severity. The total TS is equal to the maximum thermal severity in the coking stage plus the thermal severity during the heat-soak stage.
[d]Coke too pitchy for property determination.
[e]Determination on a ¾" graphitized electrode bar.

TABLE 5

EXPERIMENTAL RESULTS FOR EXAMPLE 4

| | 24-Hour Coking at 825° F. | 24-Hour Coking at 825° F. plus a 24-Hour Soak at 825° F. | | 24-Hour Coking at 825° F. plus a 24-Hour Soak at 775° F. | | 16-Hour Coking at 850° F. | 16-Hour Coking at 850° F. plus a 16-Hour Soak at 850° F. | | 16-Hour Coking at 850° F. plus a 16-Hour Soak at 775° F. | |
|---|---|---|---|---|---|---|---|---|---|---|
| Feedstock | TS,* $10^{-17}$, hr | TS* | Coke CTE*** | TS | Coke CTE*** | TS, $10^{-17}$, hr | TS | Coke CTE*** | TS | Coke CTE*** |
| Thermal Tar | 3.2 | 6.5 | 1.60 (.01)** | 3.8 | 1.56 (.19) | 4.7 | 9.5 | 1.46 (.11) | 5.1 | 1.54 (.32) |
| Thermally-cracked Decant Oil | 3.2 | 6.5 | 1.50 (.14) | 3.8 | 2.89 (.32) | 4.7 | 9.5 | 1.14 (.22) | 5.1 | 2.04 (.26) |

*TS = thermal severity = [exp (−52873/T[°R])] × Rx time, hr.
**In all cases, three determinations of the CTE were made. The value in parenthesis gives the standard deviation of the coke based upon these three determinations.
***Determined by the X-ray method.

EXAMPLE 4

A thermal tar and thermally-cracked decant oil, with properties and $TS_N$ shown in Table 1, were coked in laboratory-scale batchwise coke drums at 100 psig and at temperatures of 825° and 850° F. The coke drums then were subjected to heat-soak while at the same pressure at either the temperature of coke formation or at 775° F.

Table 5 reviews results from these experiments. Coking for 24 hours at 825° F. and 16 hours at 850° F. subjects the feeds throughout the entire batchwise coke drums to thermal severities of $3.2\times10^{-17}$ *'hr and* $4.7\times10^{-17}$ hr, respectively.

These severities are relatively close to and greater than $4.5\times10^{-17}$ hr, which is the thermal severity necessary ($TS_N$) to produce coke of the best properties from the particular thermal tar studied. This result would indicate that additional heat soak would not be expected to significantly lower the CTE of coke from this feed. The result shown in the table confirms the $TS_N$-based prediction. Heat soaks of the thermal tar at widely differing severities (24 hours at 825° F. and 24 hours at 775° F.) both give coke with CTE of about $1.6\times10^{-17}$/°C. For the thermally-cracked decant oil of Table 5, however, the $TS_N$ is $20.9\times10^{-17}$ hr, which is much greater than the thermal severity achieved by coking for 24 hours at 825° F. or 16 hours at 850° F. For this feed, heat-soaking under more severe conditions at the temperature of coke formation would be expected to produce coke with superior properties to heat-soaking at 775° F. This result is confirmed by the data. Based upon the standard deviations shown in the table, the CTE differences obtained by heat-soaking at the temperature of coke formation and at 775° F. are statistically significant at the 99% confidence level.

While certain embodiments and details have been shown for the purpose of illustrating the present invention, it will be apparent to those skilled in this art that various changes and modifications may be made herein without departing from the spirit or scope of the invention.

We claim:

1. In a delayed premium coking process in which an aromatic mineral oil feedstock is heated to elevated temperature and introduced continuously to a coking drum under delayed coking conditions wherein the heated feedstock soaks in its contained heat to convert the feedstock to cracked vapors and premium coke at lower than normal coking temperatures and in which the introduction of feedstock to the coking drum is discontinued after the coking drum is filled to the desired level, the improvement which comprises (1) determining the percentage of carbon atoms in the aromatic form as $f_a$, (2) determining the minimum soaking time for the aromatic oil feedstock having $f_a$ as determined in (1) by the equation $TS_{SOAK} \geqq TS_M$, where $TS_M = \exp(0.050\times f_a - 42.8)$ (3) subjecting the contents of the coking drum to a heat soak at substantially the same temperature as the temperature at which the coke was formed to obtain premium coke, and then (4) heat soaking the coke drum contents for at least the soaking time as determined by step (2).

2. The process of claim 1 in which the aromatic mineral oil feedstock is selected from the group consisting of decant oil, pyrolysis tar, vacuum resid, vacuum gas oil, thermal tar, heavy premium coker gas oil, virgin atmospheric gas oil and extracted coal tar pitch.

3. The process of claim 2 wherein the soaking time is determined for the aromatic oil feedstock used by the equation $TS_{Soak} \geqq TS_N$ wherein $TS_N = \exp(0.050 \times f_a - 39.8)$.

4. In a delayed premium coking process operated at lower than normal coking temperatures in which an aromatic mineral oil feedstock is heated to between about 850° F. and about 950° F. and introduced continuously to a coking drum wherein the heated feedstock soaks in its contained heat at a temperature between about 800° F. and about 925° F. and a pressure between about 15 psig and about 200 psig for a time period of between about 4 and about 60 hours which is sufficient to convert the feedstock to cracked vapors and premium coke and in which the introduction of feedstock to the coking drum is discontinued after the coking drum is filled to the desired level, the improvement (1) determining the percentage of carbon atoms in aromatic form as $f_a$, then, (2) determining the minimum soaking time for the aromatic oil feedstock having $f_a$ as determined in (1) by the equation $TS_{SOAK} \geqq TS_M$, where $TS_M = \exp(0.050 \times f_a - 42.8)$ (3) subjecting the contents of the coking drum to a heat soak at substantially the same temperature as the temperature in the coking drum during the soaking operation to obtain premium coke, and then (4) heat soaking the coke drum contents for at least the soaking time as determined by step (2).

5. The process of claim 4 in which the aromatic mineral oil feedstock is selected from the group consisting of decant oil, pyrolysis tar, vacuum resid, vacuum gas oil, thermal tar, heavy premium coker gas oil, virgin atmospheric gas oil and extracted coal tar pitch.

6. The process of claim 4 wherein the soaking time is determined for the aromatic oil feedstock used by the equation $TS_{Soak} \geqq TS_N$, wherein $TS_N = \exp(0.050 \times f_a - 39.8)$.

* * * * *